US008474360B1

(12) United States Patent
Mensch

(10) Patent No.: US 8,474,360 B1
(45) Date of Patent: Jul. 2, 2013

(54) REMOTELY OPERABLE MACHINE GUN CHARGING APPARATUS

(75) Inventor: Russell D. Mensch, Caddo Mills, TX (US)

(73) Assignee: Contract Fabrication and Design, LLC, Princeton, TX (US)

( * ) Notice: Subject to any disclaimer, the term of this patent is extended or adjusted under 35 U.S.C. 154(b) by 31 days.

(21) Appl. No.: 13/544,083

(22) Filed: Jul. 9, 2012

Related U.S. Application Data

(62) Division of application No. 13/111,343, filed on May 19, 2011.

(60) Provisional application No. 61/370,869, filed on Aug. 5, 2010.

(51) Int. Cl.
*F41A 7/06* (2006.01)

(52) U.S. Cl.
USPC ..... 89/1.4; 89/9; 89/136

(58) Field of Classification Search
USPC ..... 89/1.4, 148, 9, 11
See application file for complete search history.

(56) References Cited

U.S. PATENT DOCUMENTS

| | | | | |
|---|---|---|---|---|
| 2,413,416 | A * | 12/1946 | Ostlund et al. | 89/1.4 |
| 2,767,615 | A * | 10/1956 | Hardy | 89/1.4 |
| 2,773,425 | A * | 12/1956 | Weeks | 89/1.4 |
| 2,847,908 | A * | 8/1958 | Boals | 89/1.4 |
| 3,427,925 | A * | 2/1969 | Horn | 89/136 |
| 4,966,063 | A * | 10/1990 | Sanderson et al. | 89/37.22 |
| 4,974,499 | A * | 12/1990 | Sanderson et al. | 89/1.4 |
| 7,089,844 | B2 * | 8/2006 | Becker | 89/9 |

* cited by examiner

*Primary Examiner* — Stephen M Johnson
*Assistant Examiner* — John D Cooper
(74) *Attorney, Agent, or Firm* — Haynes and Boone, LLP

(57) ABSTRACT

A remotely operable machine gun charger is provided for selectively controlling the forward-to-rear movement of a machine gun bolt pin. When the bolt pin is released from its safe position the charger permits the bolt pin to be spring-driven back to its armed position substantially instantaneously by the bolt spring without waiting for pin engagement and drive structure portions of the gun to be returned to their forwardmost positions. The charger permits the gun to be fired during such movement of the engagement and drive structure back to their forwardmost positions, and the charger may be mounted on and removed from the machine gun without the use of tools, or the necessity of removing or adjusting any of the internal components of the machine gun.

6 Claims, 16 Drawing Sheets

REMOTELY OPERABLE MACHINE GUN CHARGING APPARATUS

CROSS-REFERENCE TO RELATED APPLICATIONS

This application is a division of co-pending U.S. application Ser. No. 13/111,343 filed on Mar. 19, 2011 and claiming priority from U.S. provisional application No. 61/370,869 filed on Aug. 5, 2010, each such prior application being incorporated herein by reference in its entirety.

BACKGROUND OF THE INVENTION

In the past, various types of charging apparatus have been used in conjunction with machine guns to selectively move the machine gun's bolt pin between a forwardly disposed "armed" position in which the gun is ready to fire, and a rearwardly disposed "safe" position in which firing of the gun is prevented until the bolt pin is returned to its armed position. U.S. Pat. No. 4,974,499 to Sanderson et al, which is hereby incorporated herein by reference, illustrates and describes an electrically driven machine gun charging system which is representatively utilized in conjunction with a .50 caliber machine gun and comprises an actuating member which is drivable between first and second positions. The actuating member, during driven movement toward its second position, engages the bolt pin of the machine gun and drives it rearwardly to its safe position, against the biasing force of its associated return spring when the actuating member reaches its second position.

Electric drive means are provided and are selectively operable to drive the actuating member in opposite directions between its first and second positions. Latch means operate to engage and releasably hold the bolt pin in its safe position in response to movement of the actuating member to its second position. The latch means are further operative to hold the bolt pin in its safe position during electrically driven return movement of the actuating member from its second position to its first position. Release means, operative in response to driven return movement of the actuating member to its first position, cause the latch means to be disengaged from the bolt pin to permit the bolt pin to be rapidly moved, by its return spring, forwardly from its safe position to its armed position.

While this previously utilized gun charging system has proven to be well suited for its intended purpose, it has several limitations and disadvantages. For example, to remove the charging system from the gun, and then replace it or mount a new charging system on the gun requires removal of and subsequent replacement of certain internal components of the gun, thereby complicating charging system service or replacement. Additionally, the return of the bolt pin from its safe position to its armed position (at which point the gun can be fired) is delayed until the actuation member is electrically driven from its rearwardly disposed second position clear back to its forwardly disposed first position. This undesirably delays firing of the gun when its bolt pin is in its safe position. Further, the charging system, which has numerous parts, is relatively complex, large and heavy.

It would be desirable to provide an improved machine gun charging system which eliminates or at least substantially minimizes these limitations and disadvantages associated with the above-described conventional gun charging system. It is to this goal that the present invention is primarily directed.

DETAILED DESCRIPTION

Figure 1:
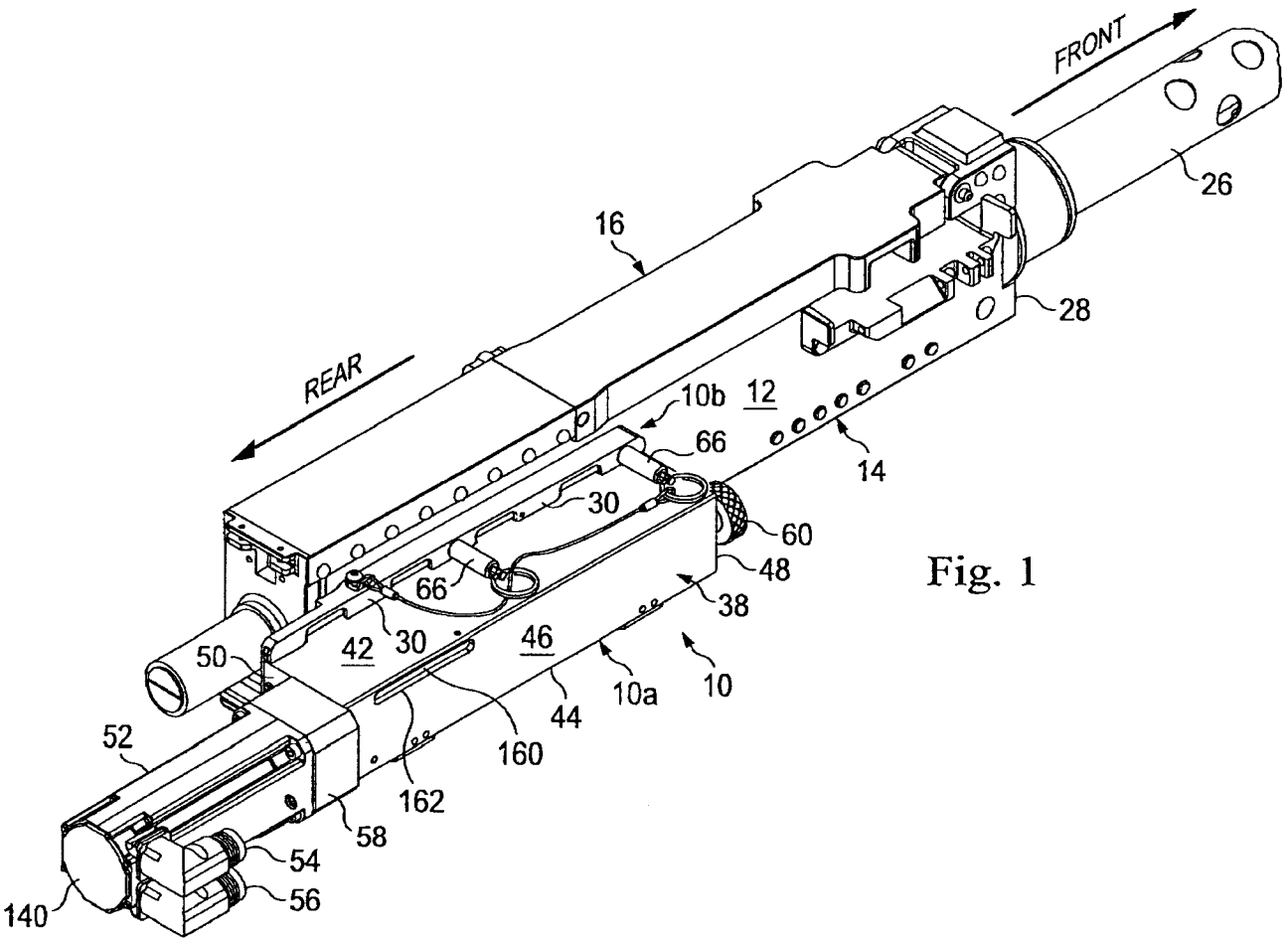
FIG. 1 is a perspective view of a representative machine gun upon which is operatively mounted a specially designed remotely operable gun charger embodying principles of the present invention.
Figure 2:
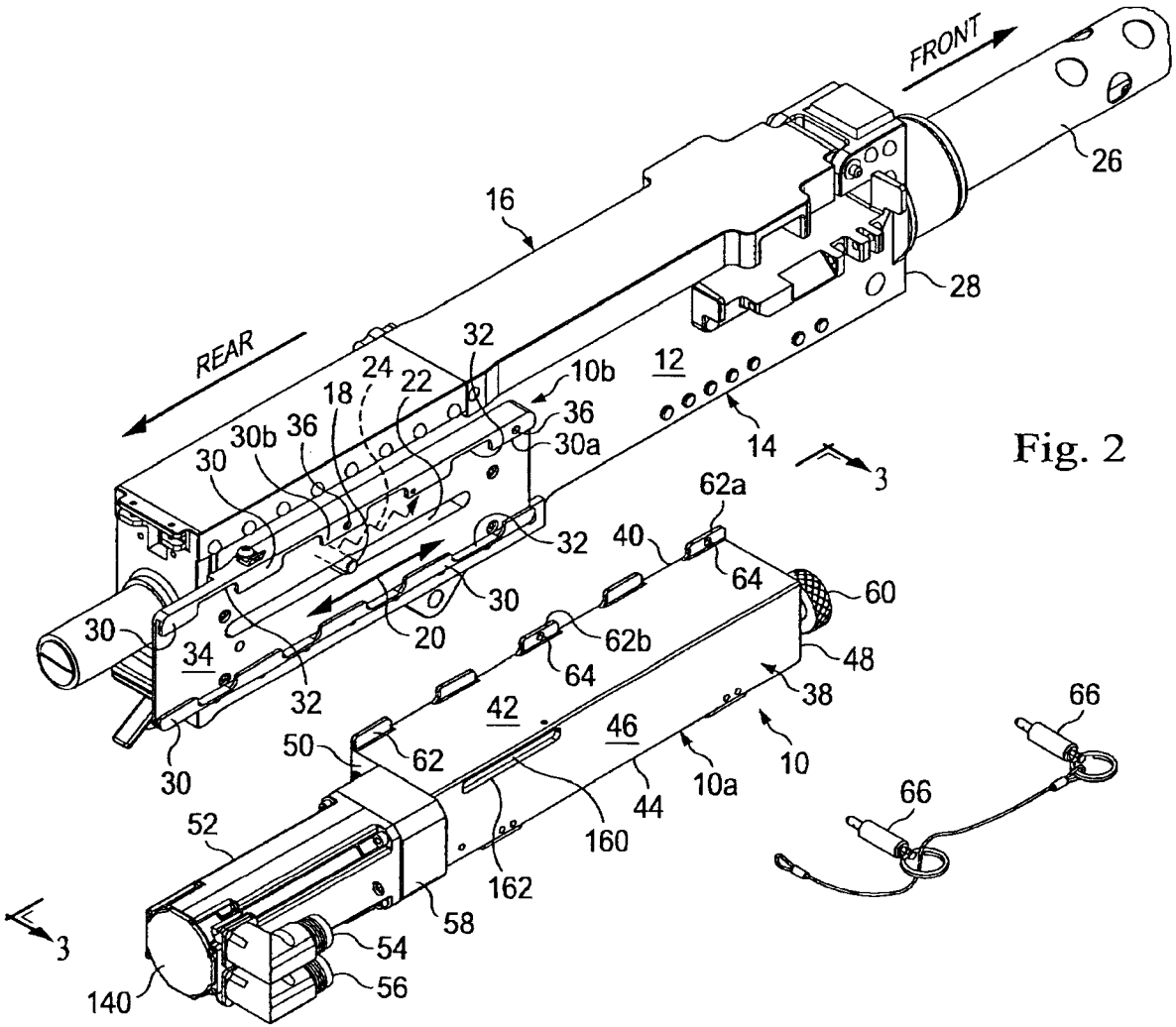
FIG. 2 is a partially exploded view similar to that in FIG. 1, but with the charger housing and its internal components removed from a gun-supported mounting plate portion of the charger.

With initial reference to FIGS. 1 and 2, the present invention provides a specially designed charger 10, having body portion 10*a* and a mounting plate portion 10*b*, which may be operatively mounted on a side wall 12 of the body 14 of a machine gun, representatively a .50 caliber machine gun 16 (see FIG. 1), and remotely operated to selectively move the bolt pin 18 of the machine gun (see FIG. 2) forwardly and rearwardly, as indicated by the double-ended arrow 20 in FIG. 2, between "armed" and "safe" positions as later described herein. Bolt pin 18 projects outwardly through a horizontally elongated slot 22 in the mounting plate 10*b* which is screwed to the machine gun body side wall 12, the bolt pin 18 being forwardly biased by a bolt return spring 24 disposed within the machine gun body 14 and shown in phantom in FIG. 2. As shown in FIGS. 1 and 2, the barrel 26 of the machine gun 16 extends forwardly from the front end 28 of the machine gun body 14. While the charger 10 is illustratively associated with a .50 caliber machine gun, it will be readily appreciated by those of skill in this particular art that it could also be utilized in conjunction with other types of machine gun if desired.

For purposes later described herein, positioned along the top and bottom edges of the mounting plate 10*b* are series of vertically inwardly projecting tabs 30 interdigitated with vertical notches 32, the tabs 30 being outwardly spaced apart from the generally planar body 34 of the mounting plate 10*b*. Mounting holes 36 are formed in upper tabs 30*a* and 30*b*.

Figure 5:
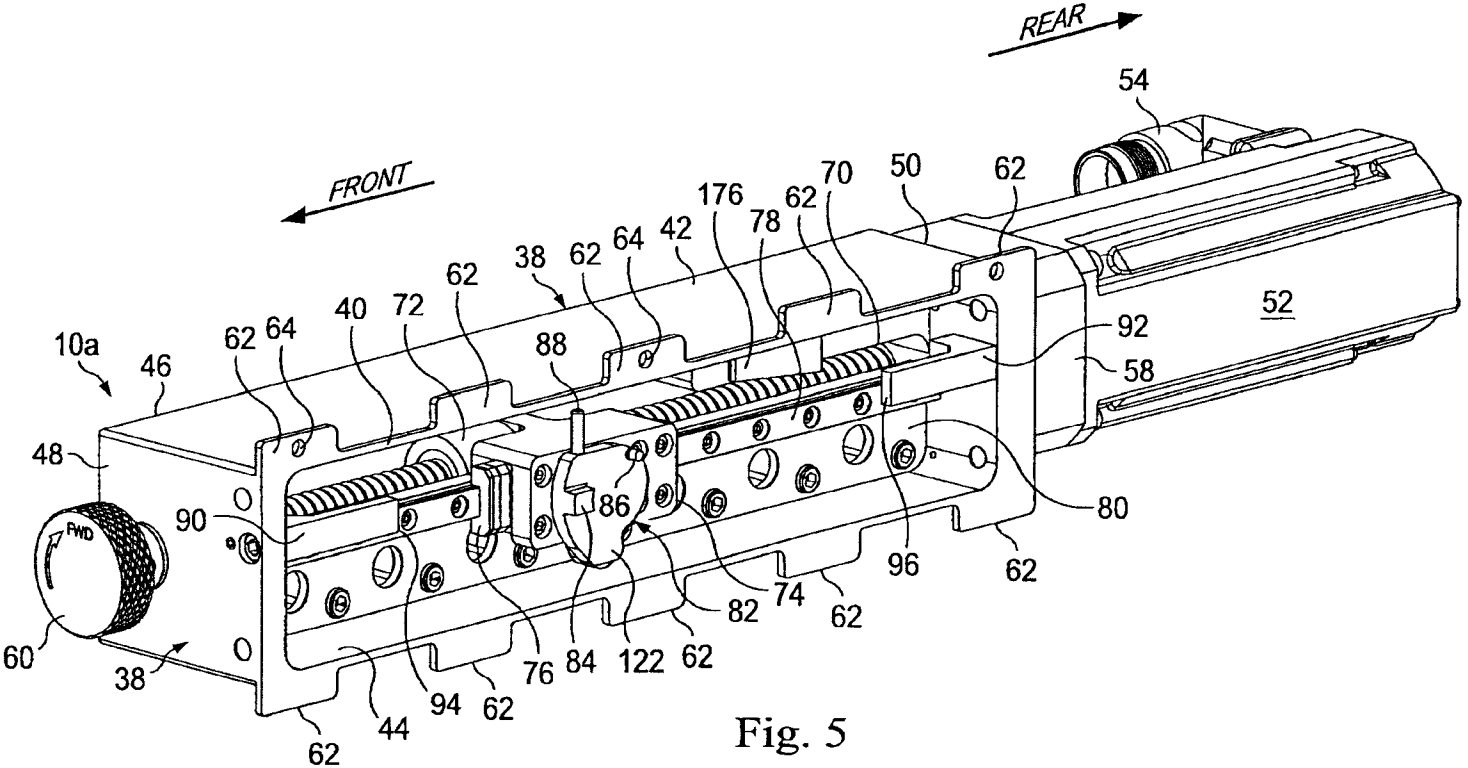
FIG. 5 is an inner side perspective view of the removed gun charger portion shown in FIG. 2.

Turning now to FIGS. 2 and 5, the charger body portion 10*a* includes a horizontally elongated hollow rectangular housing 38 having an open inner side 40, a top wall 42, a bottom wall 44, an outer side wall 46, a front end wall 48, and a rear end wall 50. An electric drive motor 52, having secured thereto a resolver connector 54 and an electric power connector 56, is mounted on the front body end wall 50 by means of a motor adapter member 58. For purposes later described herein, an adjustment knob 60 projects outwardly from the front body end wall 48 and is rotatably secured thereto.

Spaced series of mounting tabs 62 project upwardly and downwardly from the top and bottom side walls of the charger body portion housing 38 at the open inner side 40 thereof, with upper tabs 62*a* and 62*b* having mounting holes 64 formed therein. The tab and notch arrays on the facing sides of the charger body portion 10*a* and mounting plate portion 10*b* advantageously permit the charger portions 10*a* (including the various subsequently described charger operating components disposed within housing 38) and 10*b* to be rapidly mated and uncoupled, to thereby facilitate charger removal and repair or replacement without the use of tools or the necessity of removing, adjusting or otherwise accessing any parts within the machine gun 16. To install the charger body portion 10*a* on the mounting plate portion 10*b* (see FIG. 2), all that is necessary is to move body tabs 62 into mounting plate notches 32 and then horizontally move body tabs 62*a*,62*b* into underlying alignment with mounting plate tabs 30*a*,32*b*, and then insert ball pins 66 into the aligned tab openings 64 and 36. Subsequent removal of the body portion 10*a* is achieved simply by reversing these steps.

Figure 6:
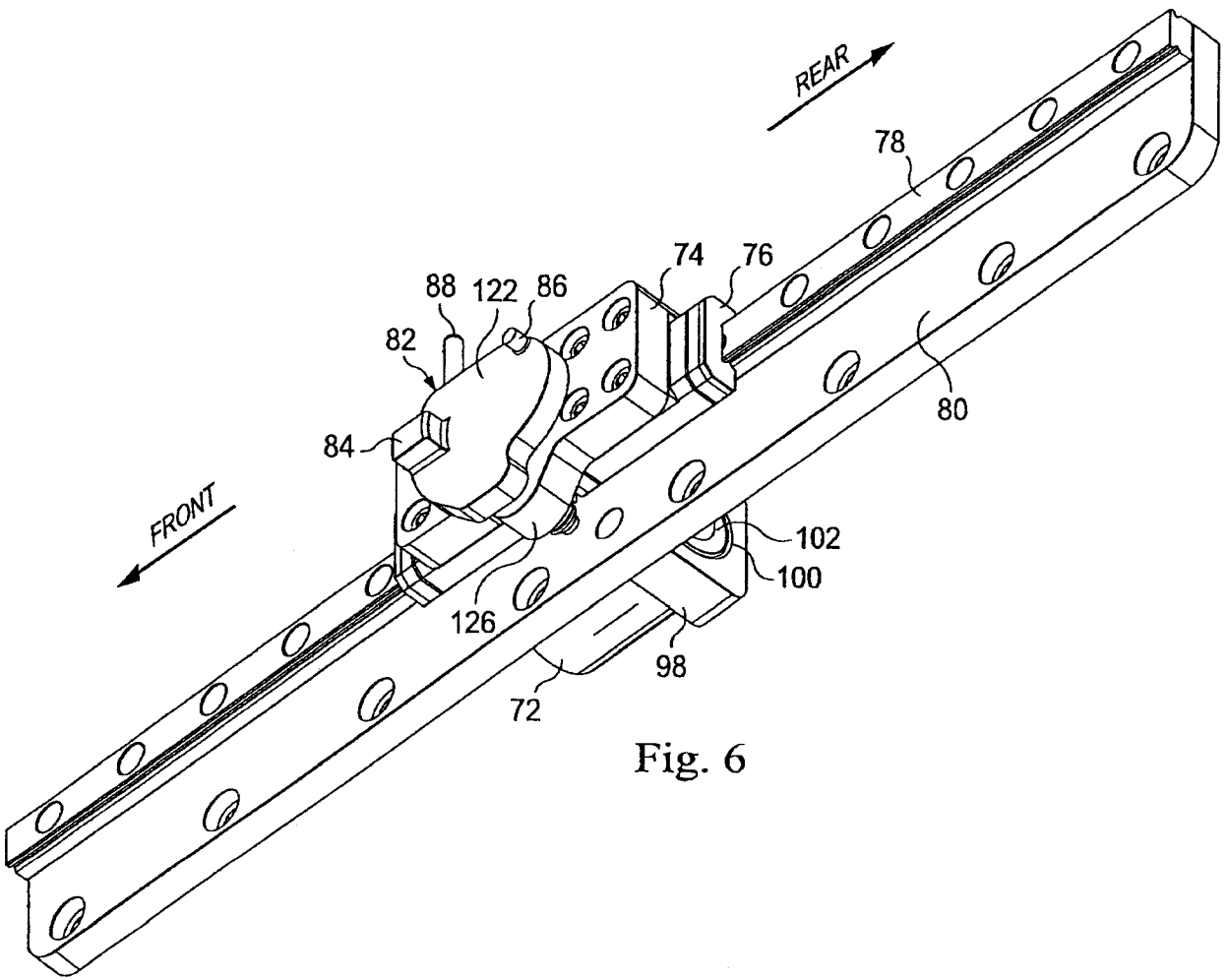
FIGS. 6 and 7 are perspective views of a hook/stage/.slider subassembly portion of the charger illustrating its connection to a mount plate/rail subassembly portion of the charger.
Figure 7:
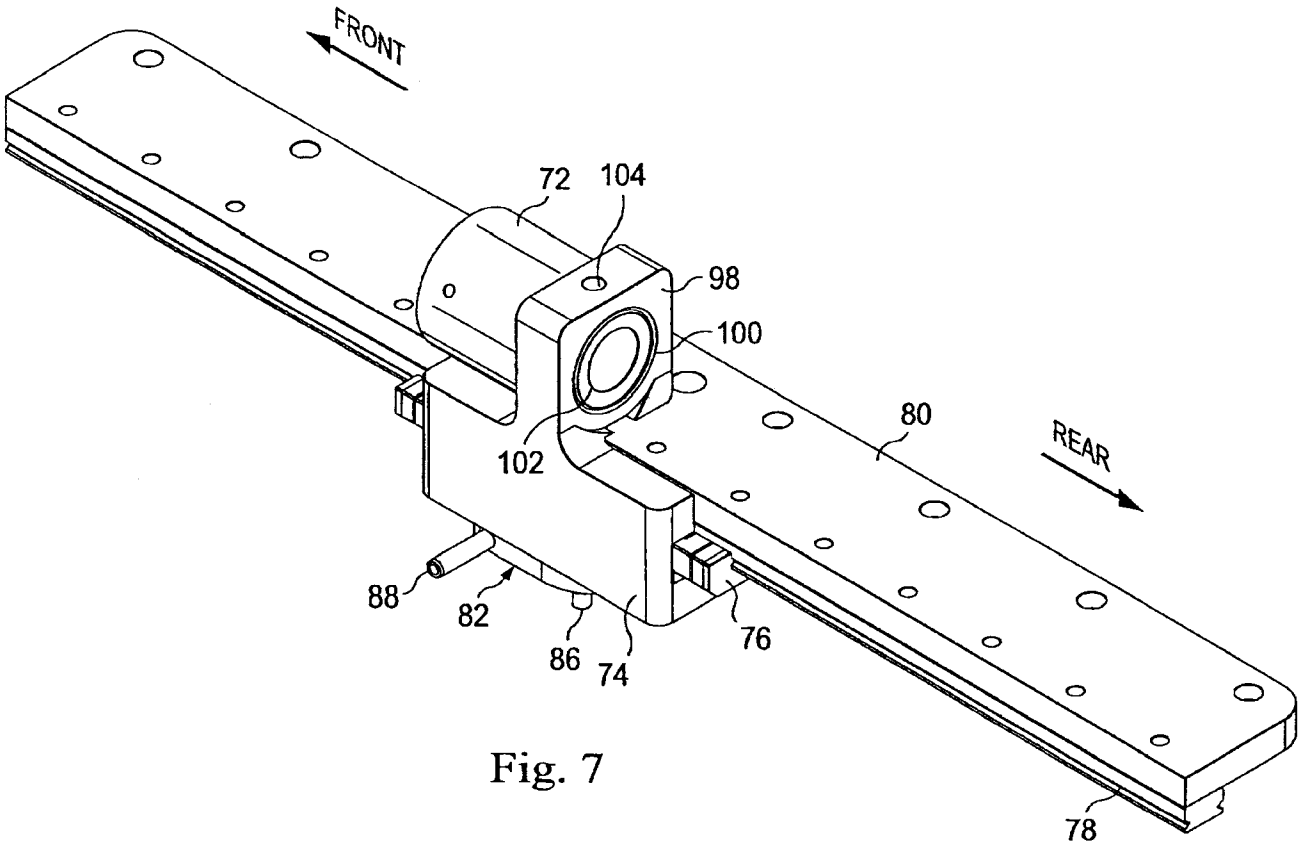

The charger operating components disposed within the housing 38 are perspectively illustrated in FIG. 5 and include an elongated ball screw 70 longitudinally extending forwardly and rearwardly through the interior of the housing 38, with the front end of the screw being anchored to the rotatable knob 60, and the rear end of the screw being drivably coupled to the motor 52. A ball nut 72 is threaded onto the screw 70, for forward or rearward driven rotation in response to rotation of the screw, and is fixedly secured to a stage structure 74 which, in turn, is anchored to a slider member 76 that slides forwardly and rearwardly along a horizontally elongated profile rail 78 mounted on a horizontally elongated mount plate 80 anchored within the interior of the housing 38. Perspective detail views of the interconnected ball nut 72, stage structure 74, slider member 76, profile rail 78 and mount plate 80 are shown in FIGS. 6 and 7.

With reference now to FIGS. 5-9, a bolt pin engagement and drive structure in the form of a generally plate-shaped hook member 82 is carried on an outwardly facing side portion of the stage 74 for rotation relative thereto about a horizontal axis perpendicular to the ball screw 70. On its outer side the hook member 82 has an outwardly projecting bolt pin engagement block 84 and a short outwardly projecting pin 86. Projecting outwardly from an edge of the hook member 82 is a longer pin member 88. Elongated rectangular front and rear stop members 90,92 (see FIG. 5) respectively project inwardly from the front and rear housing end walls 48 and 50, with the front stop member 90 having a rear end 94, and the rear stop member 92 having a front end 96. As can be seen, motor-driven rotation of the ball screw 70 in an appropriate direction can drive the stage 74, the slider 76 and the hook member 82 either forwardly or rearwardly within the charger housing 38. Alternatively, the adjustment knob 60 (see FIG. 1) can be used to manually turn the ball screw 70 in selectively opposite rotational directions if desired.

Stage structure 74, as best illustrated in FIGS. 6-9, has a generally U-shaped configuration, straddles the interconnected profile rail 78 and mount plate 80, and has a flange portion 98 with a threaded opening 100 therein into which a threaded end 102 of the ball nut 72 is threaded. Ball nut end 102 is releasably retained in the opening 100 by means of a set screw 104 received in a side wall opening 106 in the flange 98.

Figure 8:
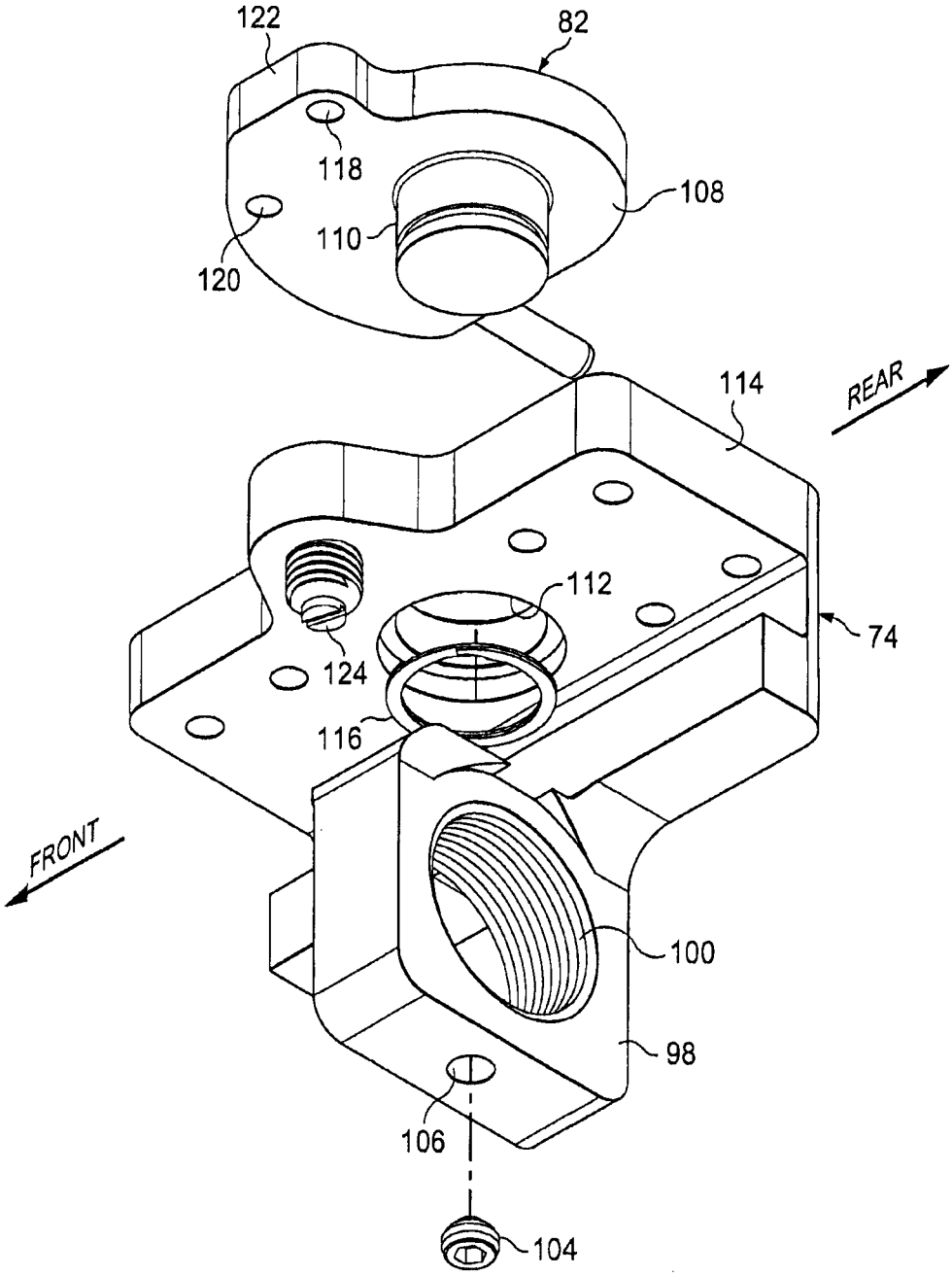
FIGS. 8 and 9 are enlarged scale exploded perspective views of the hook and stage portions of the charger.
Figure 9:
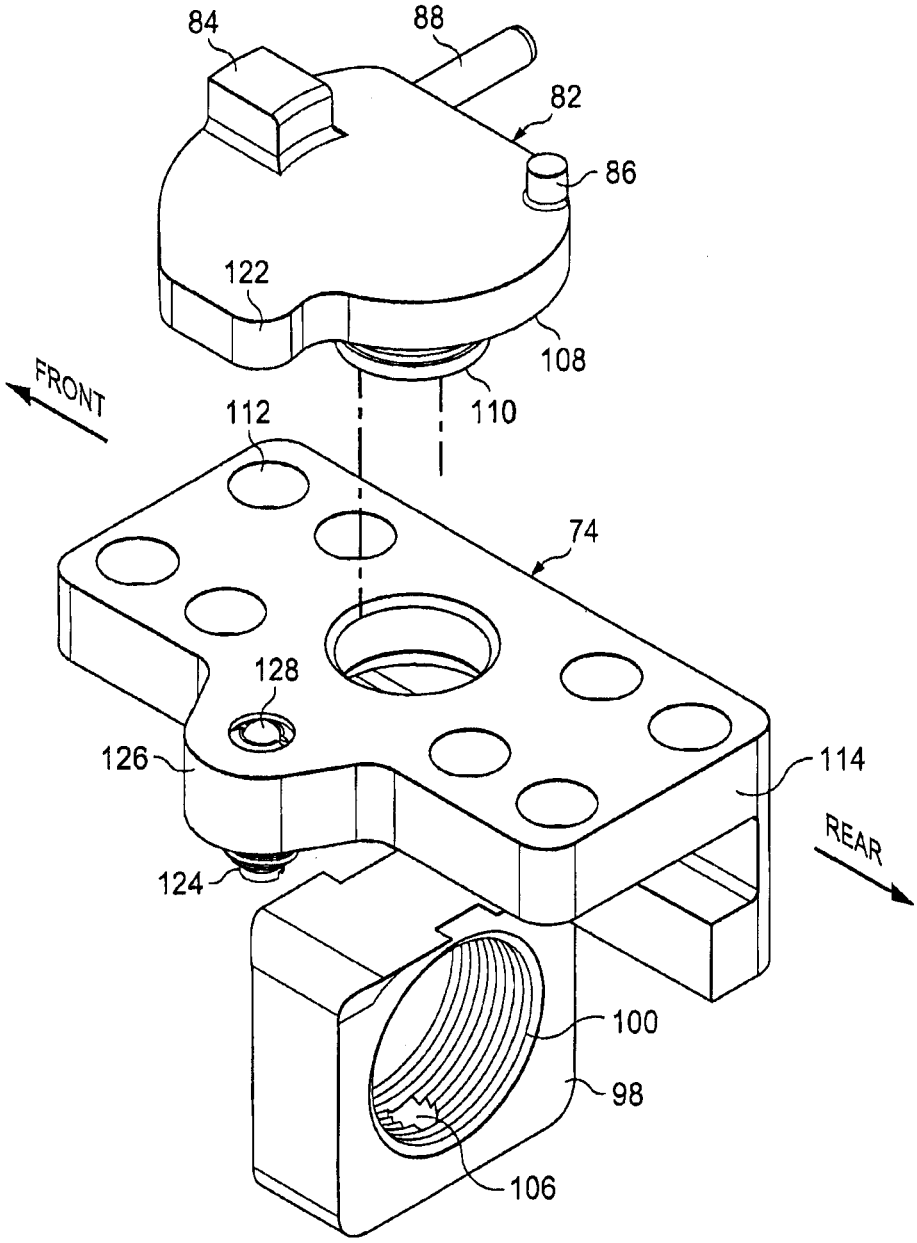

Turning now to FIGS. 8 and 9, the hook member 82, on its inner side 108, a downwardly projecting cylindrical boss 110 rotatably received in a corresponding circular hole 112 formed in a top wall 114 of the stage structure 74, the boss 110 being captively retained in the hole 112 using a snap-on spiral retaining ring 116. The hook member 82 is rotatable relative to the top wall 114 of the stage structure 74, about the axis of the cylindrical boss 110, between releasably retained first and second rotational positions relative to the stage structure 74. This releasable retention is achieved by means of two detent recesses 118,120 formed on the underside 108 of the hook member 82 on a lobe portion 122 (see FIG. 8) in cooperation with a ball spring plunger assembly 124 extending through a lobe portion 126 of the top wall 114 of the stage structure 74 and having a spring-loaded top end ball 128 (see FIG. 9).

Under the management of a control system 130 (schematically depicted in FIG. 4 and subsequently described herein) the forward and rearward movement of the hook member portion 82 may be remotely controlled, thus controllably moving the machine gun bolt pin 18 between "safe" and "armed" positions as will now be described with reference to FIGS. 3A-3F.

Figure 3A:
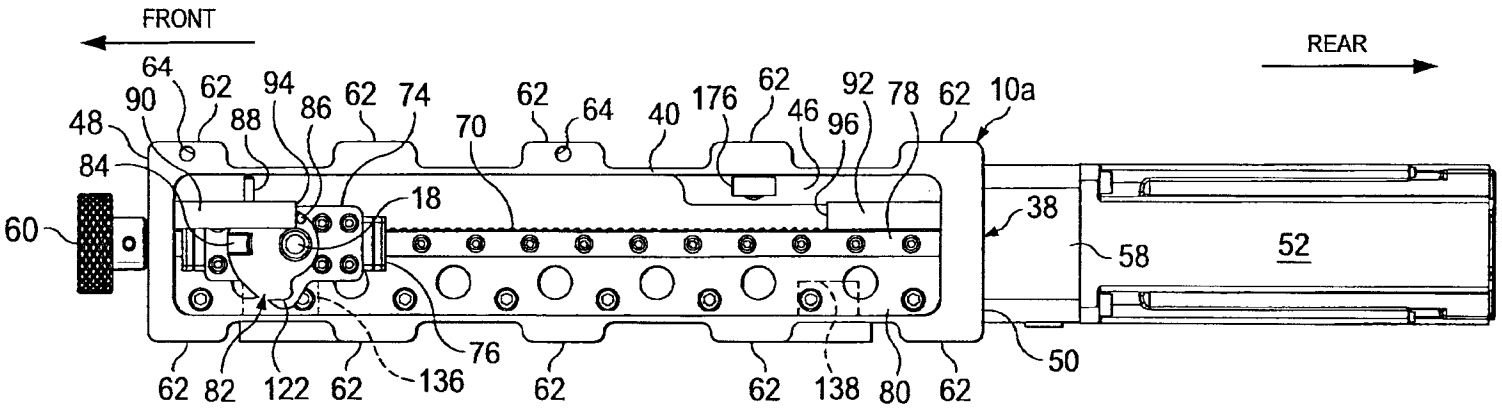
FIGS. 3A-3F are inner side elevational views of the removed portion of the charger, taken along line 3-3 of FIG. 2, and sequentially illustrate the controlled movement by the charger of the machine gun bolt pin between its armed and safe positions.

For purposes of description it will be assumed that the bolt pin 18 is initially in its forwardmost "armed" position as shown in FIG. 3A. In this position of the bolt pin 18, hook member 82 is in its forwardmost translational limit position, and its first detent-retained rotational position in which the pin 88 is in a vertical orientation in which it extends upwardly from the body of the hook member 82. The small hook member pin 86 bears against the rear end 94 of the front stop member 90, and the hook member engagement block 84 is disposed somewhat forwardly of the bolt pin 18.

Figure 3B:
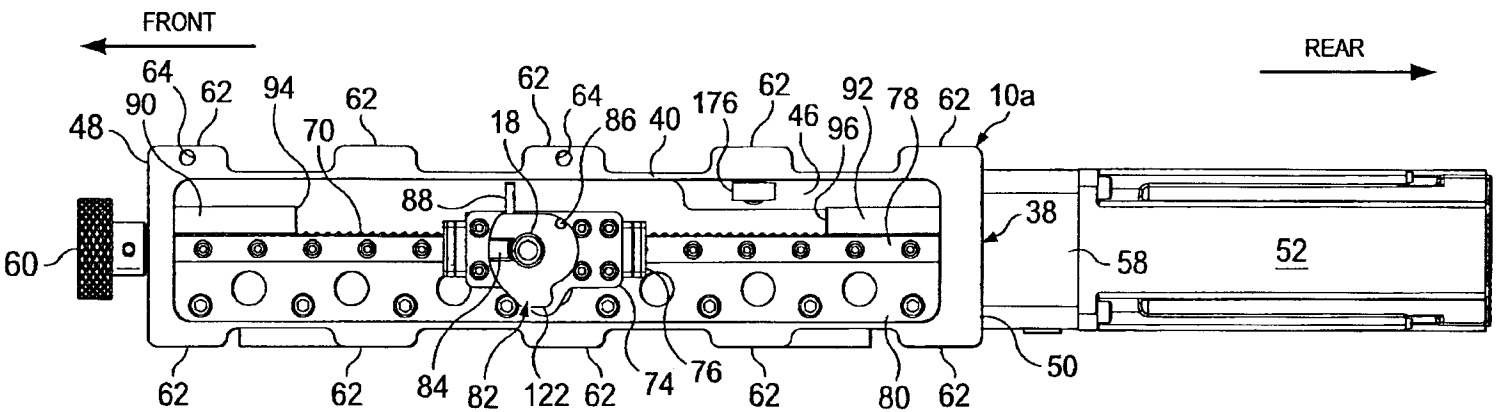
Figure 3C:
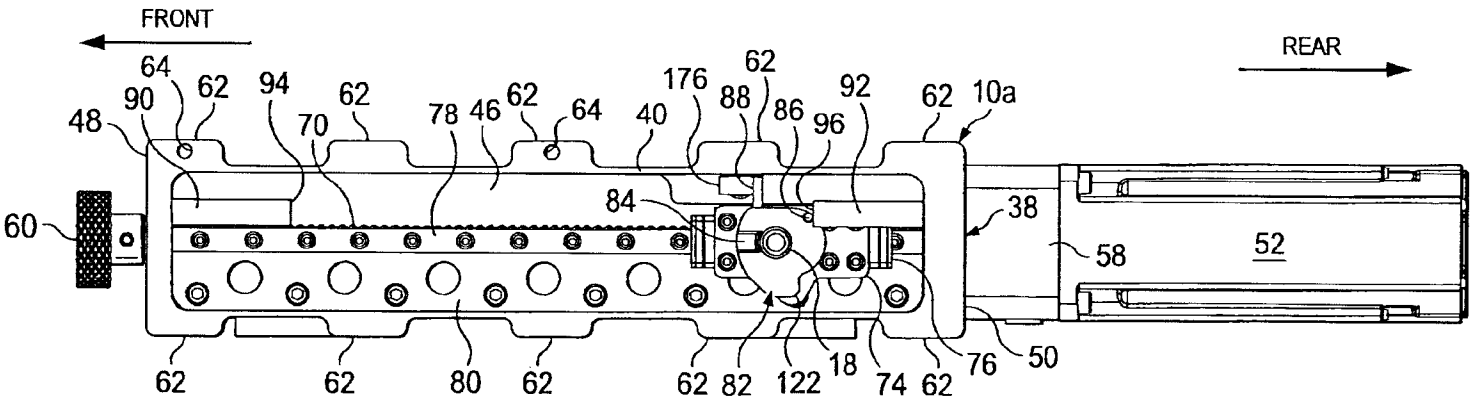

When it is desired to move the bolt pin 18 rearwardly to its "safe" position, the charger motor 52 is used to appropriately rotate the ball screw 70 to rearwardly drive the hook member 82. During an initial portion of the driven rearward travel of the hook member 82 (which is still in its first rotational position), its engagement block portion 84 contacts the bolt pin 18 and drives it rearwardly as shown in FIG. 3B. As shown in FIG. 3C, when the bolt pin 18 rearwardly reaches its "safe" position, motor operation is terminated with the bolt pin 18 still forcibly engaged with the hook member block 84 (due to the operation of the bolt spring), the hook member 82 still in its first rotational position, and the hook member pin 86 disposed just forwardly of the front end 96 of rear stop member 92. In this "safe" orientation of the bolt pin 18, the machine gun 16 is prevented from firing until returned to its FIG. 3A "armed" position.

Figure 3D:
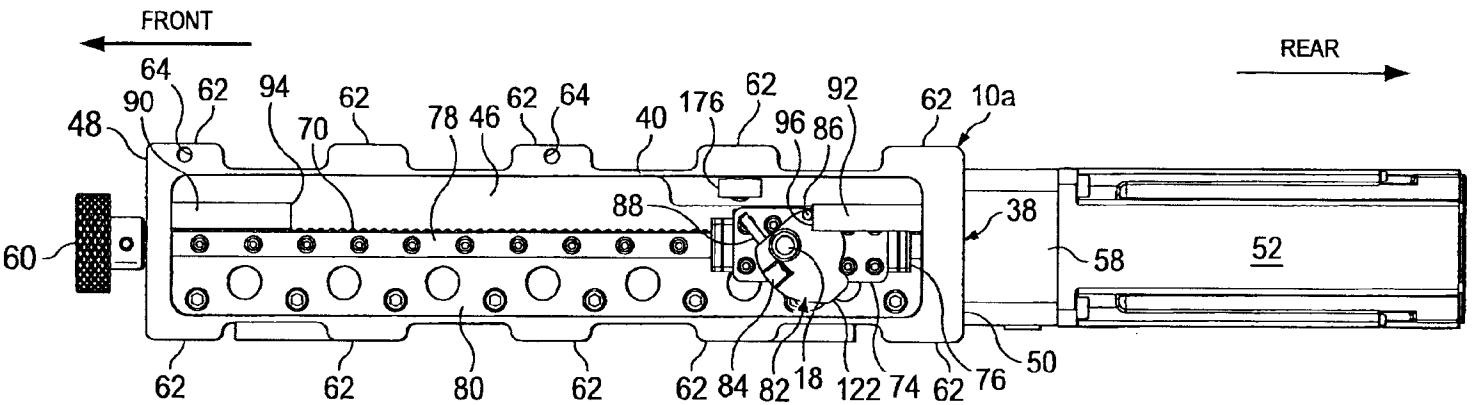
Figure 3E:
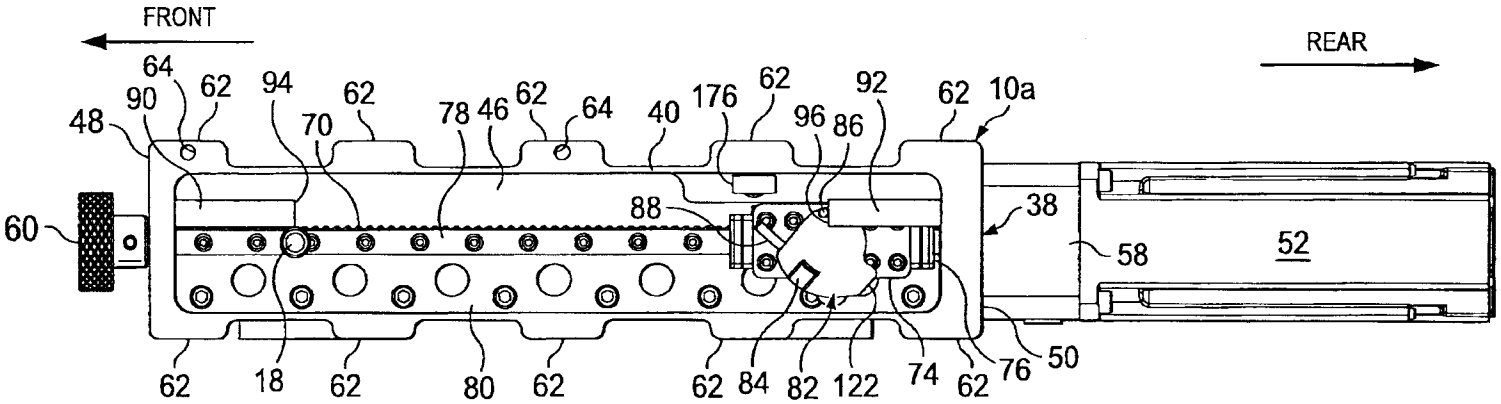

When it is desired to return the bolt pin 18 from its FIG. 3C "safe" orientation to its FIG. 3A "armed" orientation, the motor 52 is used to drive the hook member 82 rearwardly past its "safe" orientation as shown in FIG. 3D. As shown in FIG. 3D, this causes the rearwardly traveling hook pin 86 to be forcibly engaged by the front surface 96 of the rear stop member 92 to thereby rotate the hook member 82 in a counterclockwise direction away from its detent-retained first position. Such rotation moves the hook member block 84 out of forwardly blocking engagement with the bolt pin 18, thereby permitting the bolt pin spring to snap the bolt pin 18 forwardly back to its "armed" position shown in FIG. 3E as the hook member 82 continues to be driven a short distance rearwardly until the rear stop member 92 further pivots the hook member 82 in a counterclockwise direction to its detent-retained second position as shown in FIG. 3E.

Figure 3F:
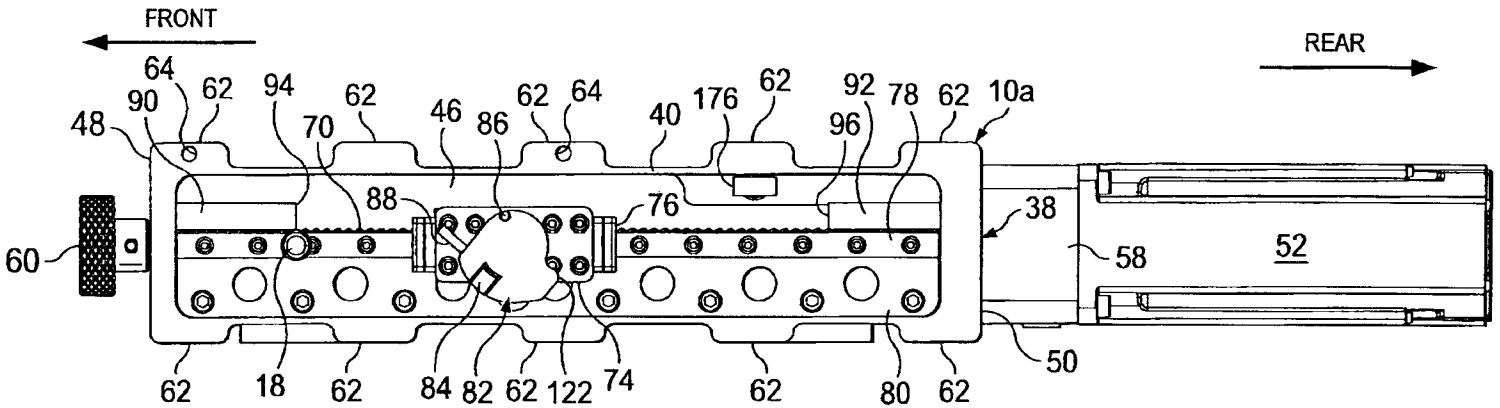

Next, as shown in FIG. 3F, the hook member 82, still in its second rotational position, is screw-driven forwardly through the interior of the charger body housing 38. As it approaches the bolt pin 18, the rear end 94 of the forward stop member 90 engages the hook member pin 88 to thereby rotate the hook member 82 in a clockwise direction back to its detent-retained first rotational position in which, as shown in FIG. 3A, the hook member engagement block 84 is spaced forwardly apart from the bolt pin 18 in its "armed" position.

It should be noted that with the hook member 82 in its second rotational position the engagement block 84 is disposed beneath the reciprocating front-to-rear travel path of the bolt pin 18, the hook member pin 86 is disposed above such travel path, and the body of the hook member 82 and the hook member pin 88 are interposed between the outer end of the bolt pin 18 and the outer side wall 46 of the charger body housing 38. Accordingly, as soon as the bolt pin 18 is released from the contact with the engagement block 84 (as shown in FIG. 3D) the bolt pin 18 is free to be spring-returned to its "armed" position (see FIG. 3E) and the machine gun 16 can be fired—even while the hook member 82 is being returned forwardly to its FIG. 3A position. Stated in another manner, firing of the gun is not delayed until the hook member 82 returns to its FIG. 3A position. As subsequently described herein, the hook member 82 may alternatively be screw-driven (in a "recocking" sequence) from its FIG. 3A position to its FIG. 3E position without being temporarily held in its FIG. 3C "safe" position.

Figure 4:
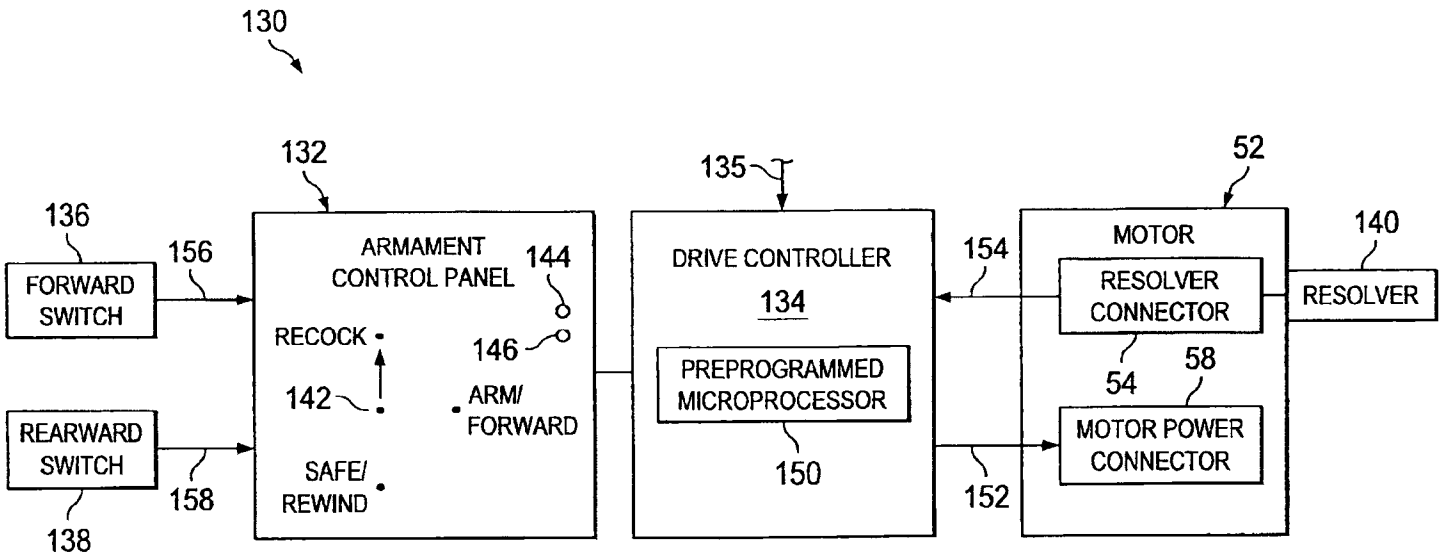
FIG. 4 is a schematic diagram of a control system operatively associated with the gun charger.

Turning now to FIG. 4, the previously mentioned control system 130 includes an armament control panel 132, a drive controller 134, forward and rearward position switches 136 and 138, and a resolver portion 140 of the electric drive motor. Armament control panel 132 has a selector switch portion 142 which may selectively rotated among "recock", "arm/fwd" and safe/rwd" positions, a forward position indicating light 144, and a rearward position indicating light 146. Armament control panel 132 is coupled to a preprogrammed microprocessor portion 150 of the drive controller 134 which, in turn, is powered via an electrical power supply lead 135. Upon receipt of a signal indicative of the selected position of the armament control panel switch 142, the drive controller 134, under the control of the microprocessor 150, transmits electrical power to the motor power connector 58 via a lead 152 to appropriately drive the bolt pin hook member 82. The resolver portion 140 of the motor 52 measures motor speed, rotational direction and number of revolutions, and transmits to the drive controller 134, via the resolver connector 54 and a feedback lead 154, motor operational data that permits the microprocessor 150 to appropriately start, stop and otherwise control the motor 52.

Positional information with respect to the hook member 82 is generated by the forward and rearward switches 136 and 138 which are schematically depicted in phantom in FIG. 3A. When the hook member 82 is in its forward "armed" position, a bottom side portion of the stage structure 74 depresses the forward switch 136 which responsively transmits a position confirmation signal 156 to the armament control panel 132 and also causes the forward position indicator light 144 thereon to be illuminated. When the hook member 82 is in its rearward "safe" position, a bottom side portion of the stage structure 74 depresses the rearward switch 138 which responsively transmits a position confirmation signal 158 to the armament control panel 132 and also causes the rearward position indicator light 146 thereon to be illuminated.

Figure 10A:
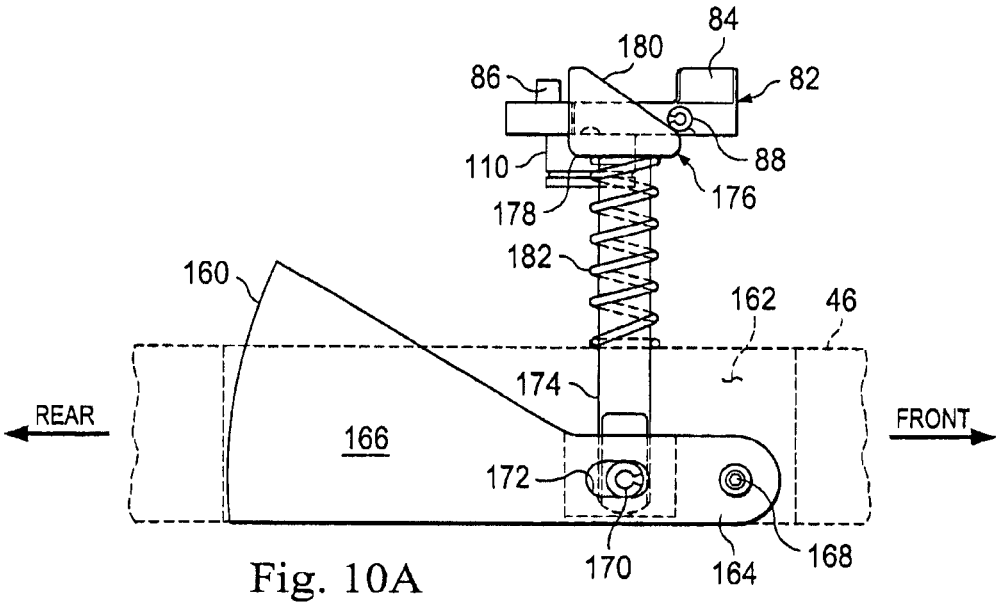
FIGS. 10A and 10B are enlarged scale top plan views of a hook-operated bolt pin position indicating flag structure portion of the charger sequentially illustrating its operation.
Figure 10B:
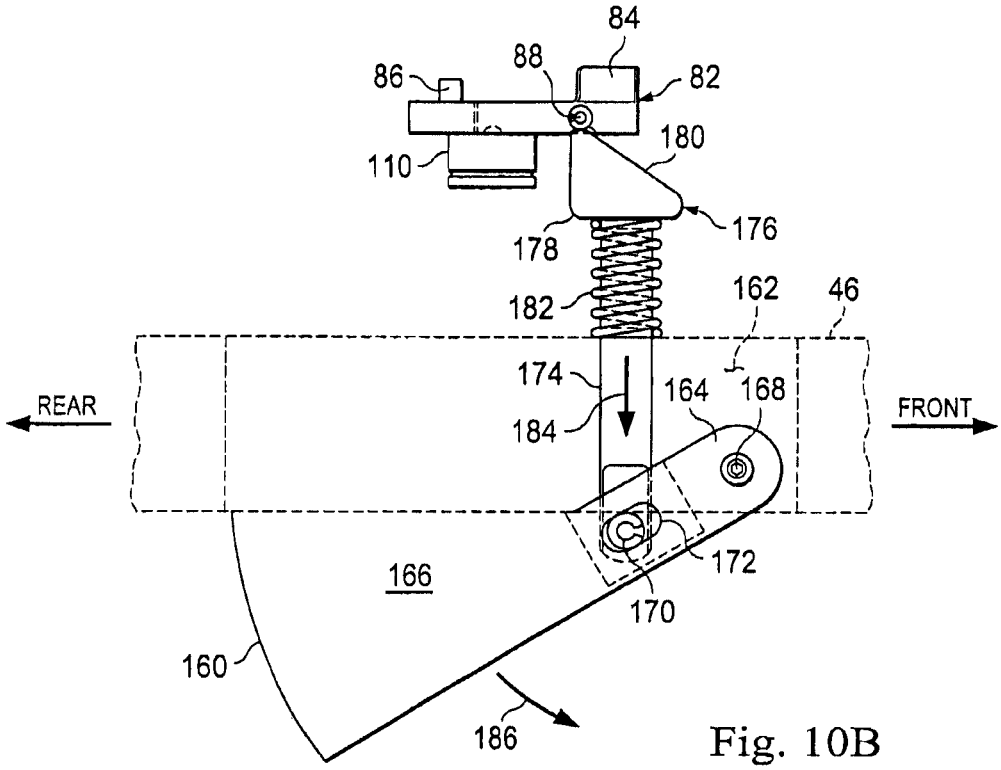
Figure 11:
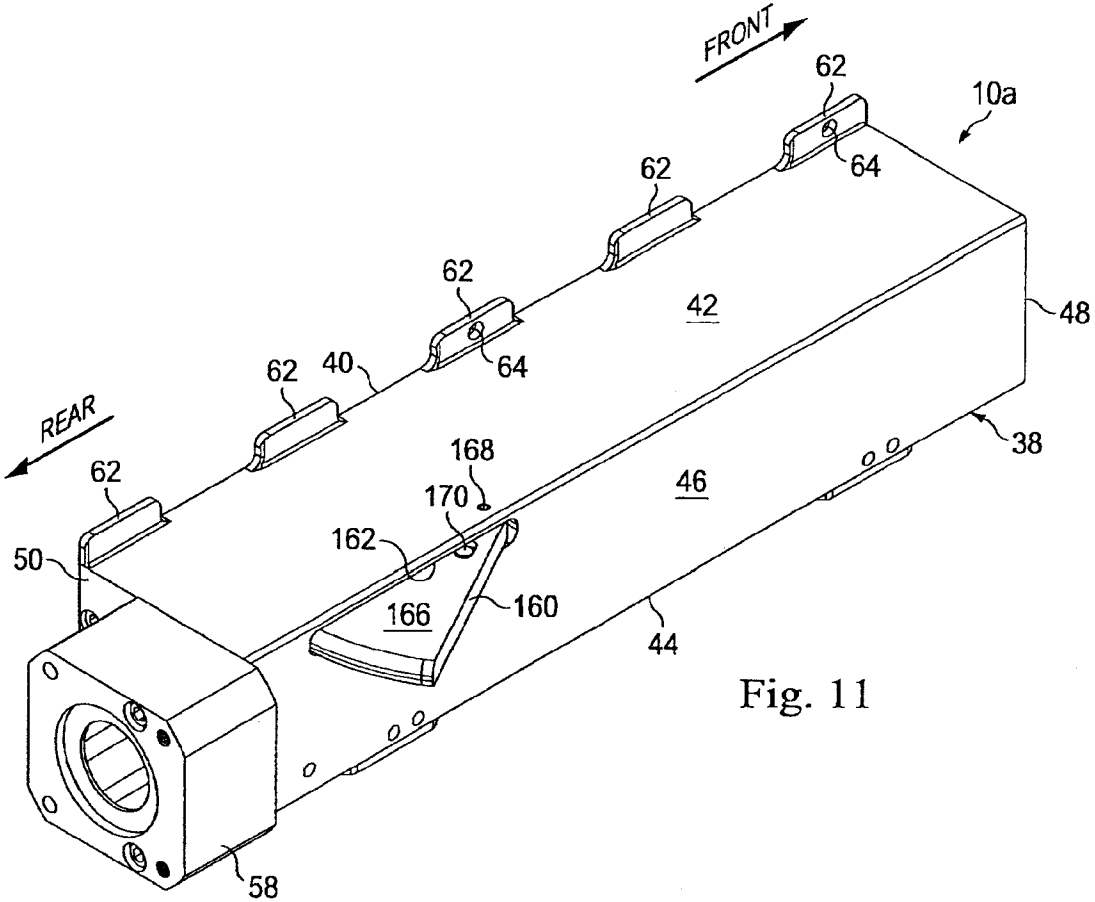
FIG. 11 is an outer side perspective view of the charger housing showing the flag projecting outwardly from a slot in its outer side wall.

With reference now to FIGS. 10A, 10B and 11, in addition to the positional indicia provided by the switches 136 and 138 and their associated indicating lights 144 and 146, the charging system also provides a user thereof with a visual indication on the charger body housing 38 that the bolt pin 18 is in its rearwardly disposed "safe" position. An elongated, generally plate-shaped flag member 160 is carried in a slot 162 formed in the outer side wall 46 of the charger body housing 38 and has a narrow front end 164 and a wider rear end 166. The front end 164 is pivotally connected to the wall 46 by a vertical pin 168 that permits the rear end 166 of the flag 160 to horizontally swing into and out of the slot 162 as may be seen by comparing FIG. 10A to FIGS. 10B and 11.

Another vertical pin 170 is received in a lost motion slot 172 extending through the flag member 160, and is also secured to the outer end of a horizontally oriented rod 174 extending into the slot 162. Secured to the inner end of the rod 174 is a ramp member 176 (see also FIGS. 3A-3F and 5) having an outer side surface 178 and a ramped inner side surface 180. Circumscribing the rod 174 is a coil spring 182 that bears at its opposite ends against the inner side surface of the housing wall 46 and the outer side surface 178 of the ramp member 176 and resiliently biases the ramp member 176 in an inward direction (i.e., in an upward direction as viewed in FIGS. 10A and 10B).

As the hook member 82 rearwardly approaches its "safe" position, its pin 88 initially engages the ramped surface 180 as shown in FIG. 10A, and then, as shown in FIG. 10B, cams the ramp member 176 outwardly, against the resilient force of the now compressed spring 182, to thereby pivot the flag member 160 outwardly through the wall slot 162 as indicated by the arrows 184,186 in FIG. 10B, thereby providing a visual indicia (see also FIG. 11), on the exterior of the charger body housing 38, that the bolt pin 18 is in its "safe" position.

Compared to the machine gun charging apparatus illustrated and described in U.S. Pat. No. 4,974,499 the gun charger 10 of the present invention and its associated remote control system 130 provide a variety of advantages. For example, the gun charger 10 is smaller and lighter, and has considerably fewer parts. Additionally, in the charger 10 when the bolt pin is released from its safe position it is spring-driven back to its armed position substantially instantaneously by the bolt spring without waiting for the pin engagement and drive structure to be returned to its forwardmost position.

Moreover, the gun may be fired during such movement of the engagement and drive structure back to its forwardmost position. Also, the charger 10 may be mounted on and removed from the machine gun without the use of tools, or the necessity of removing or adjusting any of the internal components of the machine gun.

A variety of modifications may be made to the previously described gun charger 10 without departing from principles of the present invention. Several of such potential modifications are representatively illustrated in FIGS. 12-15.

Figure 12:
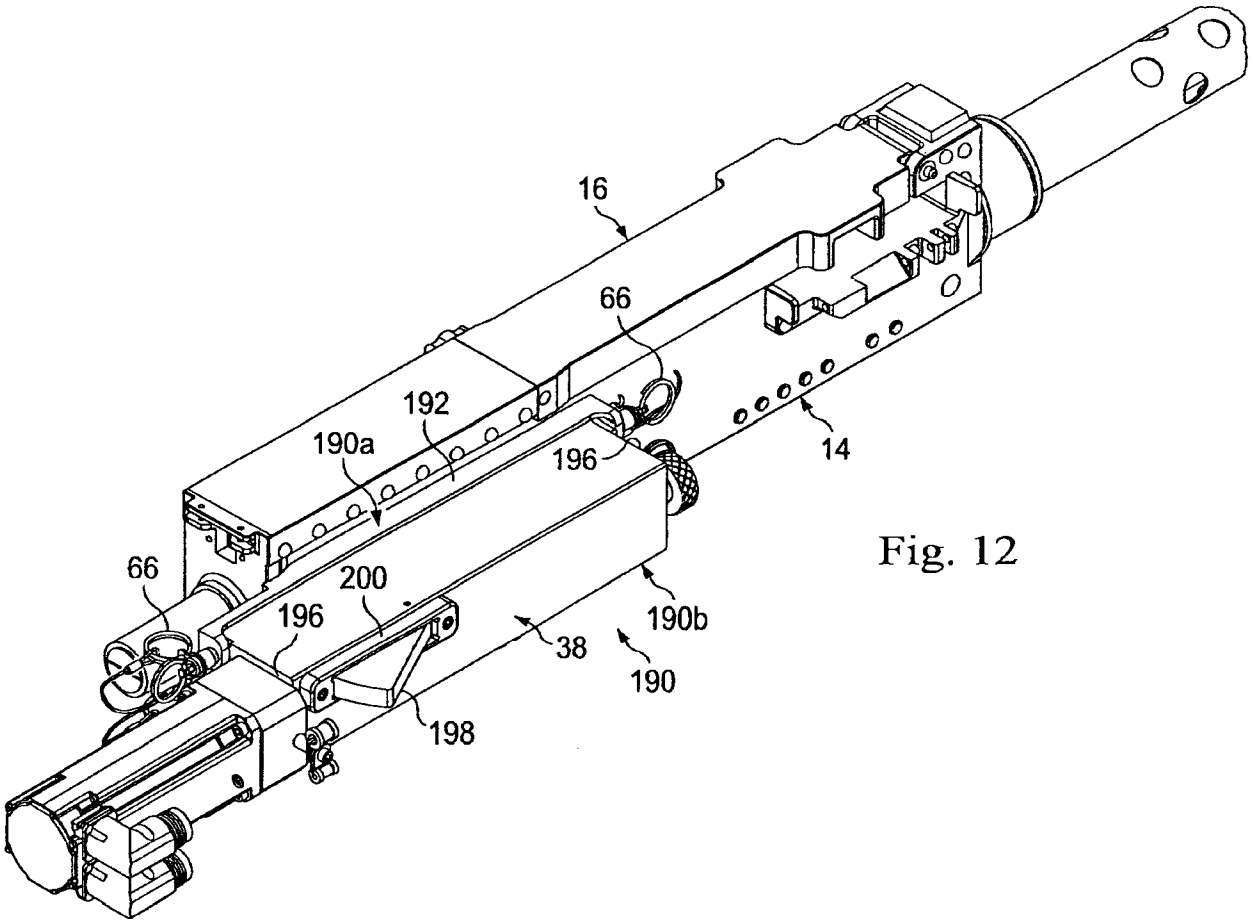
FIG. 12 is a perspective view of the FIG. 1 machine gun with an alternative embodiment of the remotely operable gun charger operatively mounted thereon.
Figure 13:
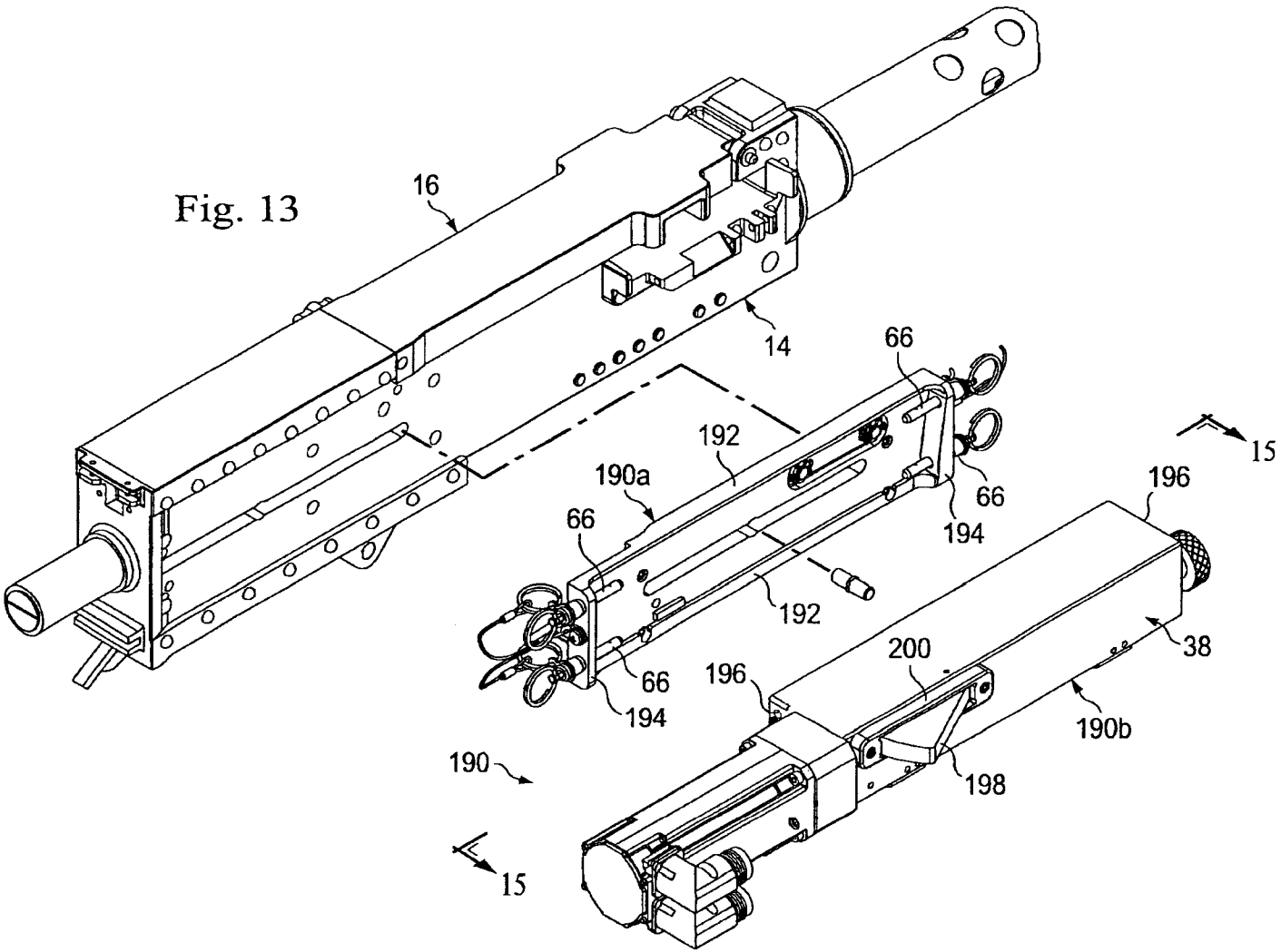
FIG. 13 is a partially exploded view similar to that of FIG. 12, but with the charger housing and its internal components removed from the mounting plate portion of the charger.

For example, an alternate embodiment 190 of the previously described gun charger 10 (see FIGS. 1 and 2) is shown in FIGS. 12 and 13 and comprises a revised charger mounting plate portion 190*a* and a revised charger body portion 190*b*. Mounting plate portion 190*a* is removably securable to the gun body 14 and has a horizontally elongated rectangular configuration, with outwardly extending side edge projections 192 and outwardly extending end edge projections 194. To removably secure the body portion 190*b* to the mounting plate portion 190*a*, without the use of tools, the horizontally elongated rectangular charger body 38 is inwardly nested within the generally frame-shaped outer side recess of the mounting plate portion 190*a* (collectively defined by the side edge projections 192 and 194) and removably secured to the plate portion 190*a* using four ball pins 60. As illustrated in FIGS. 12 and 13, two of the ball pins 66 are extended inwardly through each of the mounting plate end edge projections 194 and the underlying end wall 196 of the charger body 38 through aligned mounting holes in the projections 194 and body end walls 196.

Figure 14:
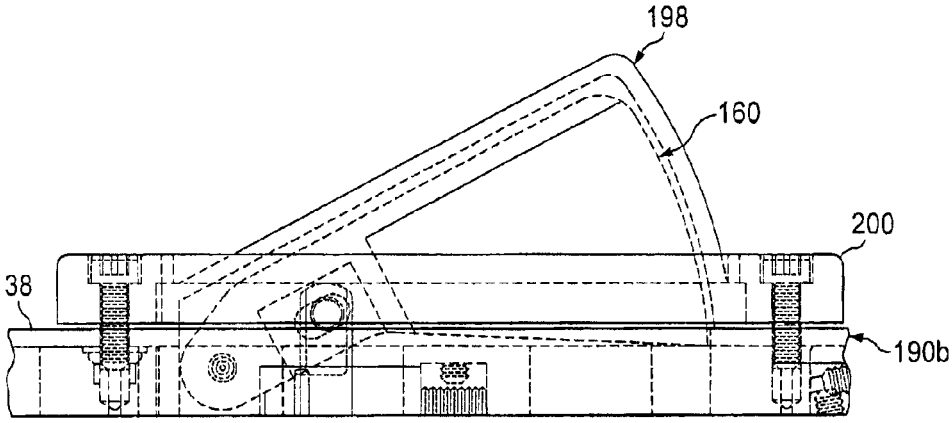
FIG. 14 is an enlarged scale top plan view of a portion of the FIG. 13 charger illustrating a protective flag housing structure projecting outwardly from its outer side.

Turning now to FIG. 14, the previously described bolt pin position indicator flag member 160 (see FIGS. 10A-11) may be provided with a protective clear plastic shroud member 198 (see also FIGS. 12 and 13) which is mounted on a rectangular support frame 200 suitably secured externally to the horizontally outer side surface of the gun charger body portion 190*b* around the opening therein through which the flag member 160 outwardly projects. The shroud member 198 protects the flag member 160 from damage, and also seals around its associated charger body opening to prevent dust, dirt and the like from entering the interior of the charger body 38 therethrough.

Figure 15:
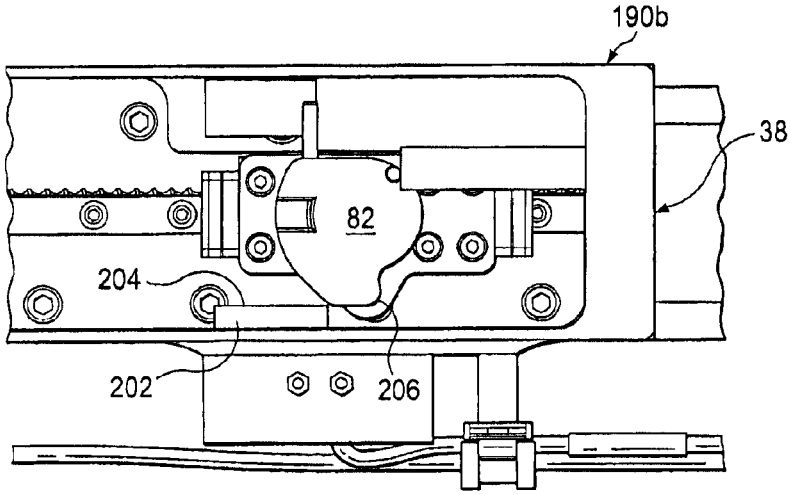
FIG. 15 is an enlarged scale inner side elevational view of the removed charger of FIG. 13, taken generally along line 15-15 of FIG. 13, illustrating a striker plate member operatively disposed within the charger.

Additionally, with reference now to FIG. 15, the interior of the gun charger body portion 190*b* may be provided with a small striker plate member 202 suitably secured to the interior surface of the bottom side wall of the body 38 adjacent its right end as viewed in FIG. 15. The planar top side surface 204 of the striker plate member 202 is positioned a small distance below a flat surface area 206 of the previously described hook member 82 which is horizontally disposed and faces downwardly as the hook member 82 rightwardly travels past the striker member 202. As the hook member 82 passes rightwardly across the striker plate member 202, the upper surface 204 of the striker plate member 202 functions to block undesirable counterclockwise rotation of the hook member 82 (by forming an underlying barrier to the tilting of its flat surface 206) until the hook member flat surface 206 rightwardly passes the striker plate member 202.

The foregoing detailed description is to be clearly understood as being given by way of illustration and example only, the spirit and scope of the present invention being limited solely by the appended claims.

What is claimed is:

1. Armament apparatus comprising:

a machine gun having:

a body portion, a bolt member movable relative to said body portion between armed and safe positions, and a spring resiliently biasing said bolt member toward said armed position;

a gun charger operative to selectively engage said bolt member, drive it from said armed position to said safe position, and subsequently permit said spring to return said bolt member from said safe position to said armed position; and cooperative mounting apparatus associated with said body portion and said gun charger for releasably and operatively mounting said gun charger on said body portion, said cooperative mounting apparatus comprising releasably interlockable mounting structures carried on said body portion and said gun charger, and locking apparatus for releasably retaining said mounting structures in an interlocked relationship, said interlockable mounting structures comprising tabs carried by said body portion and said gun charger, at least some of said tabs carried by said body portion and said gun charger being movable into an aligned relationship that blocks separation of said machine gun and said gun charger, and said locking apparatus is operative to releasably maintain said at least some of said tabs in said aligned relationship.

2. The armament apparatus of claim 1 wherein:

at least some of said tabs in said aligned relationship have aligned openings extending therethrough, and said locking apparatus comprises pin members removably insertable into said aligned openings.

3. The armament apparatus of claim 1 wherein:

said machine gun is a .50 caliber machine gun.

4. Armament apparatus comprising:

a machine gun having:

a body portion, a bolt member movable relative to said body portion between armed and safe positions, and a spring resiliently biasing said bolt member toward said armed position;

a gun charger operative to selectively engage said bolt member, drive it from said armed position to said safe position, and subsequently permit said spring to return said bolt member from said safe position to said armed position; and cooperative mounting apparatus associated with said body portion and said gun charger for releasably and operatively mounting said gun charger on said body portion, said cooperative mounting apparatus defining a bayonet type mounting structure.

5. Armament apparatus comprising:

a machine gun having:

a body portion, a bolt member movable relative to said body portion between armed and safe positions, and a spring resiliently biasing said bolt member toward said armed position;

a gun charger operative to selectively engage said bolt member, drive it from said armed position to said safe position, and subsequently permit said spring to return said bolt member from said safe position to said armed position; and cooperative mounting apparatus associated with said body portion and said gun charger for releasably and operatively mounting said gun charger on said body portion, said cooperative mounting apparatus comprising:

a plate member securable to said body portion and having, along opposite first and second side edges thereof, interdigitated sets of tabs and notches, each set of tabs being bent toward the other set of tabs in a manner forming pocket areas behind the tabs in each set thereof, interdigitated sets of tabs and notches carried on opposite sides of said gun charger, the gun charger tabs being insertable into plate member notches and then moved through said pocket areas to align gun charger tabs with body portion tabs, and pin members removably insertable through openings in at least one aligned pair of the gun charger and body portion tabs to releasably maintain them in alignment with one another.

6. Armament apparatus comprising:

a machine gun having:

a body portion, a bolt member movable relative to said body portion between armed and safe positions, and a spring resiliently biasing said bolt member toward said armed position;

a gun charger operative to selectively engage said bolt member, drive it from said armed position to said safe position, and subsequently permit said spring to return said bolt member from said safe position to said armed position; and cooperative mounting apparatus associated with said body portion and said gun charger for releasably and operatively mounting said gun charger on said body portion, said cooperative mounting apparatus comprising:

a generally frame-shaped recess formed externally on said machine gun body portion and having opposing projection portions, said recess being configured to nestingly receive a portion of said gun charger, and locking pin members releasably extendable through said opposing projection portions into the received gun charger portion.

* * * * *